US005216867A

United States Patent [19]

Wasterval, Jr. et al.

[11] Patent Number: 5,216,867

[45] Date of Patent: Jun. 8, 1993

[54] WELL MAST STRUCTURE

[75] Inventors: Philip W. Wasterval, Jr.; James E. Armstrong, both of Houston, Tex.

[73] Assignee: Sundowner Offshore Services, Inc., Houston, Tex.

[21] Appl. No.: 787,684

[22] Filed: Nov. 4, 1991

[51] Int. Cl.[5] ..... E04H 12/34; B66C 23/34

[52] U.S. Cl. ..... 52/745.01; 52/123.1; 52/745.04

[58] Field of Search ..... 52/745, 123.1, 741, 52/637, 638, 648, 40, 111

[56] References Cited

U.S. PATENT DOCUMENTS

| | | | |
|---|---|---|---|
| 848,304 | 3/1907 | Hines . | |
| 2,268,796 | 1/1942 | Brauer . | |
| 2,577,642 | 12/1951 | Woolslayer et al. . | |
| 2,583,072 | 1/1952 | Wilson . | |
| 3,185,265 | 5/1965 | White . | |
| 3,396,498 | 12/1968 | Davidson, Jr. et al. | 52/123.1 |
| 3,464,169 | 9/1969 | Potain | 52/123.1 |
| 3,851,482 | 1/1974 | Le Tourneau et al. | 52/123.1 |
| 3,945,107 | 3/1976 | Houck | 52/123.1 |
| 4,134,237 | 1/1979 | Armstrong . | |
| 4,231,200 | 11/1980 | Henderson | 52/123.1 |
| 4,238,911 | 12/1980 | Mazur | 52/111 |
| 4,885,893 | 12/1989 | Wasterval, Jr. et al. . | |
| 4,885,895 | 12/1989 | Wasterval, Jr. et al. | 52/745 |

FOREIGN PATENT DOCUMENTS

| | | | |
|---|---|---|---|
| 599782 | 6/1960 | Canada | 52/123.1 |
| 440360 | 2/1927 | Fed. Rep. of Germany . | |
| 572557 | 9/1977 | U.S.S.R. . | |

*Primary Examiner*—Carl D. Friedman
*Assistant Examiner*—Wynn E. Wood
*Attorney, Agent, or Firm*—Pravel, Hewitt, Kimball & Krieger

[57] ABSTRACT

An improved well mast structure and method for building the well mast structure in the form of multiple, separately attachable sections including a bottom section, a lower section, a middle section, a top section and a crown section. A bottom section having a generally U-shaped box frame at its upper end is raised to a vertical position and a separate crown section is inserted into the open end of the U-shaped box frame and placed on top of the bottom section. The top, middle and lower sections are then installed using a similar procedure. Each section is lifted by a conventional crane until its upper end is pivotally attached to the lower end of the previously installed section. The section is then pivotally lowered to a vertical position within the bottom section and pivotally raised and secured to the previously installed section. The installed sections are then raised in a telescoping manner.

10 Claims, 4 Drawing Sheets

WELL MAST STRUCTURE

BACKGROUND OF THE INVENTION

1. Field of the Invention

The present invention relates to methods for raising well masts on offshore drilling platforms or at relatively inaccessible locations on land.

2. Description of the Related Art

Several types of well masts are known which are portable for movement between oil well sites, particularly offshore or remote sites. The portable mast structures typically comprise several smaller and more manageable sections to facilitate transportation. At the oil well location, the individual sections are extended one above the other in a telescoping fashion to make a mast of desired height.

Several types of portable telescoping well mast assemblies are known and are in use at the present time. One known type of telescoping portable mast structure is that of U.S. Pat. No. 4,885,893, commonly owned with the present application, of which Applicants are named as inventors. The mast structure disclosed in this patent provides a method to quickly and efficiently erect a mast structure while reducing damage to the mast sections during raising or erection. It includes a lower section which is raised to a vertical position on a drill floor. An upper section is then pivotally attached at its midpoint in a horizontal position to the top of the lower section, thereafter pivoted to a vertical position and then raised until a lower end of the upper section can be secured to an upper end of the lower section.

Well masts of the type disclosed in Applicants' prior patent have been accepted, particularly in the offshore drilling industry. Applicants have found that there remains room for improvement particularly when the mast has to be higher. For example, an upper section of this type of well mast is relatively large and cumbersome since it is taller than any of the other sections. This upper section also includes at its upper end as integral components both a crown platform section as well as the drilling rig traveling block. Experience has proven that the overall height, width, strength and lifting capacity of the completed well mast structure of this type is essentially limited by the upper section. This is due to the size, weight and other practical load limitations of a crane available on the platform crane used to lift each of the well mast sections during assembly. Although it was suggested that a middle section could also be added between the upper and lower mast sections following a similar procedure and more intermediate sections could be added, this was generally not the case in practice. Due to the limited load bearing capacity and strength of each section, usually at most only an upper, middle and lower section could be included as an entire well mast structure.

The completed mast structure of Applicants' prior patent typically had a clear height of approximately 96 feet, and a net hook capacity of approximately 240,000 pounds. With drilling of ever deeper wells, it would be desirable to provide a taller and stronger well mast structure having a greater lifting capacity. However, conflicting structural considerations imposed design limits. Any attempt to make the upper mast section larger or taller was limited by the lifting capacities of available cranes. Further, since no more sections could effectively be added, the mast structure erected using the procedure found in Applicants' prior patent had, in effect, a self-constrained height and lifting capacity.

SUMMARY OF THE PRESENT INVENTION

Briefly, according to the present invention, a new and improved well mast structure is provided which is stronger and taller, capable of handling stands of three pipes. In general, Applicants have discovered that in order to do so the crown section can be made a separate structural entity from the upper mast section and installed as a part of the well mast structure separately. By making the crown section a separate structure from the upper section, each other individual well mast section subsequently added to the well mast structure can be taller, wider and sturdier without violating the practical lifting limits of the crane. Since each of the remaining sections are generally wider and stronger, the completed well mast structure is sturdier thus allowing for an additional middle section so that the resulting mast structure is also significantly taller.

The procedure for erecting the well mast structure of the present invention is initiated by first raising a bottom section to a vertical position on a drill floor. Then, the crown section is lifted and connected to the top of the bottom section. A top section, a middle section and a lower section are each successively pivotally connected to the well mast structure. Each such mast section is first moved into place and connected in a horizontal position. It is then rotated to a vertical position within the bottom section, and then connected to the section immediately above it. A traveling block from the crown section is lowered within the newly installed section, scoping lines are attached to the traveling block, routed around pulleys on the bottom of each section and terminated near the upper end of the bottom section. The traveling block is then raised thereby raising all sections relative to the bottom section until the lowermost section can be latched to the bottom section.

Since the crown section is separate from the top section, each section can be wider, taller and generally sturdier than the sections of the prior structures. This allows an extra intermediate section to be added thereby providing a well mast structure which is taller and has a greater lifting capacity.

BRIEF DESCRIPTION OF THE DRAWINGS

The objects, advantages and features of the invention will become more apparent by reference of the drawings which are appended hereto wherein like numerals indicate like parts and wherein an illustrated embodiment of the invention is shown, of which.

DETAILED DESCRIPTION OF THE PREFERRED EMBODIMENT

Figure 1:
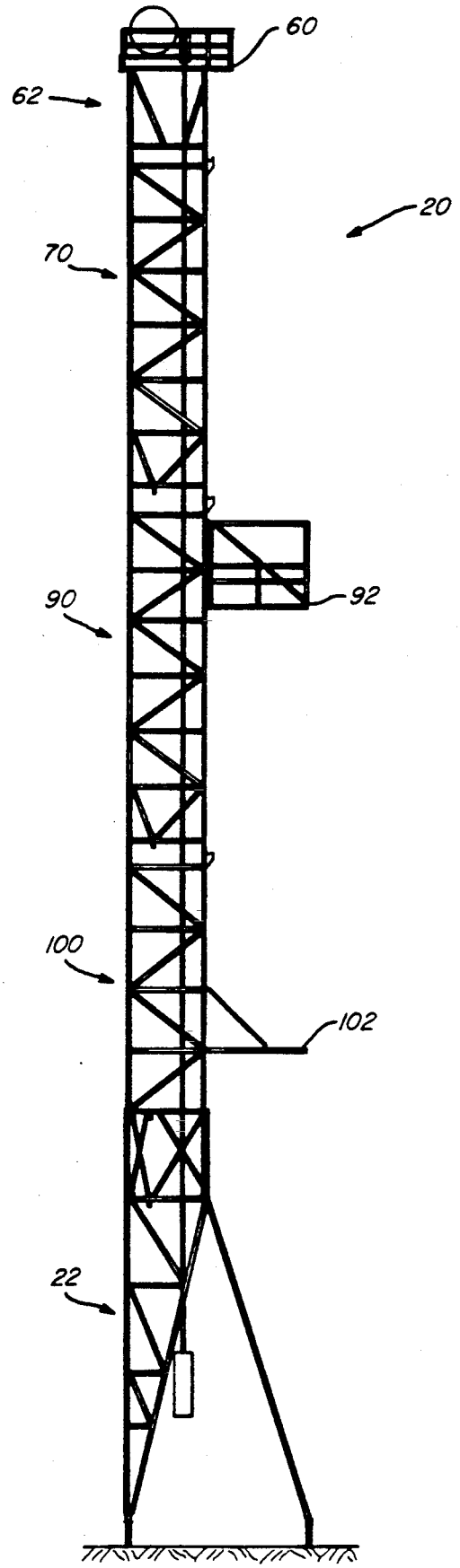
FIG. 1 is an elevation view of the well mast structure of the present invention in its raised position.

In the drawings, a well mast structure according to the present invention is indicated generally at 20. The well mast structure 20 (FIG. 1) is shown after having been assembled or erected on a well drilling site. The well drilling site may be a foundation on the ground, a truck bed, an offshore platform, the upper section of another well mast structure or other suitable substructures.

The preferred well mast structure 20 includes a separate crown section 62, a top mast section 70, a middle mast section 90 including a racking board 92, a lower mast section 100 including a belly board 102, and a bottom mast section 22. Though not shown, a conventional lifting crane is provided at the drilling site for lifting these mast sections as the well mast structure 20 is being assembled.

Figure 2:
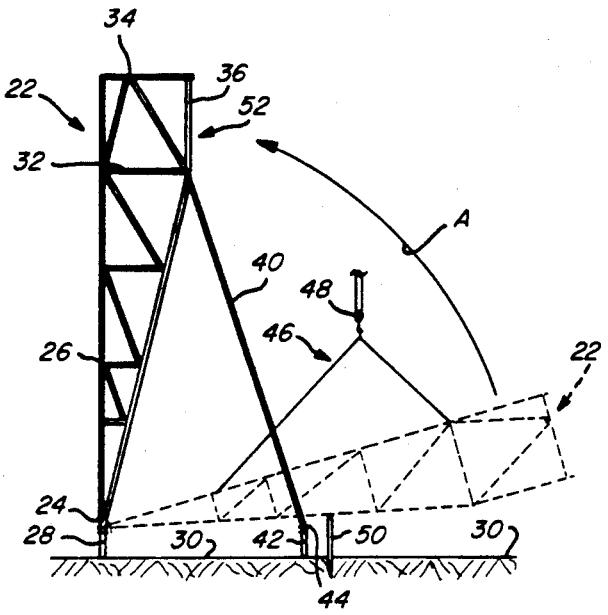
FIGS. 2, 3, 4, 5 and 6 are elevation views of a well mast structure of the present invention during initial stages of its being raised or erected.

Referring now to FIG. 2, the bottom mast section 22 is shown in an initial substantially horizontal position (phantom in drawing) during the initial stage of assembling the well mast structure 20. The bottom mast section 22 is moved into its installed and upright position in a manner similar to that described in commonly owned U.S. Pat. No. 4,885,893, of which Applicants are named as inventors, which is hereby incorporated by reference.

Figure 7:
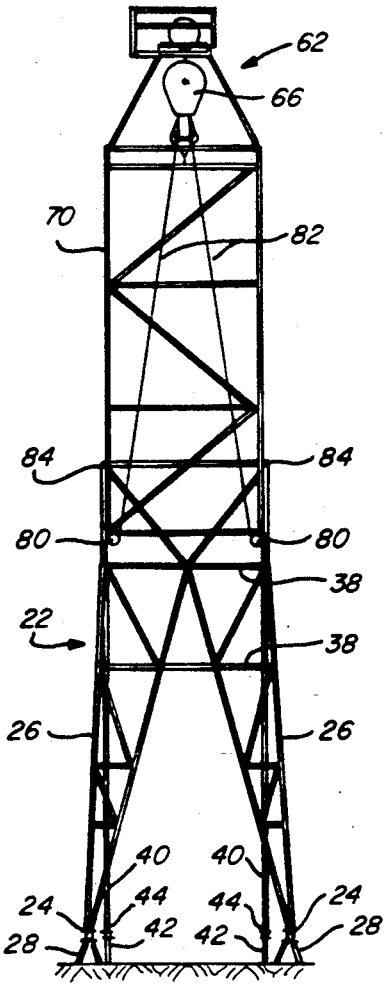
FIG. 7 is an elevation view taken at 90° from FIGS. 2 through 6, inclusive, during a further stage of raising the well mast structure of the present invention.

A pivotal attaching means or mast shoe 24 is provided on each of a pair of generally V-shaped support legs 26 at a lower end of the bottom mast section 22. The mast shoes 24 serve to attach the mast section 22 to respective upright stands or pedestals 28 on a drill floor 30 at the drilling site. Each of the support legs 26 preferably includes near its upper end a lower horizontal frame member 32 and an upper horizontal frame member 34 and a vertical support member 36 connected therebetween. The support legs 26 of the bottom mast section 22 are connected at various positions along their longitudinal extent by lateral or cross beams 38 (FIG. 7). The pedestals 28 on the drill floor 30 are adapted to fit within and be pivotally connected to the mast shoes 24 by suitable connector bolts, pins or the like.

The bottom mast section 22 also includes a pair of spaced, pivotal support legs 40 pivotally connected at their upper ends to the lower frame members 32. The support legs 40 are mounted between the support legs 26 and a second pair of spaced upright pedestals 42 mounted on the drill floor 30. A mast shoe 44 is formed at the lower end of each of the pivotal support legs 40 for attachment to a corresponding one of the upright pedestals 42. The pedestals 42 are adapted to fit within and be connected to the mast shoes 44 by suitable connector pins, bolts or the like. Prior to transport to the drilling site, the pivotal support legs 40 are each secured to their respective support legs 26 by ropes or other suitable means. The bottom mast section 22 is then connected to a four part sling 46 beneath a crane hook 48 (FIG. 2), and then lifted and moved to the position shown where the mast shoes 24 can be connected to the pedestals 28 by suitable pins or the like.

Once the mast shoes 24 are connected to the pedestals 28, the pivotal support legs 40 are released, yet remain in position because of temporary support props 50 (FIG. 2), until lifting of the bottom mast section 22 begins. The crane hook 48 is then raised as indicated by an arrow A, tilting the bottom mast section 22 gradually upwardly until the support legs 26 are in the upright position shown. At this point, the pivotal support legs 40 are hanging generally vertically. The legs 40 are then pivoted outward to the position shown (FIG. 2) so that the mast shoes 44 may be connected to the pedestals 42, completing installation of the bottom mast section 22.

The support legs 26 including the lower frame members 32, the upper frame members 34, the vertical support members 36 together with the upper cross beams 38 form an open, generally U-shaped (in horizontal cross-section) box 52 at the upper end of the bottom mast section 22. Thus, no cross beams are provided in the space between either the pivotal support legs 40 or the vertical support members 36 forming an open side of the U-shaped box 52. In this manner, an elongate, U-shaped receiving channel or slot is formed in the bottom mast section 22 once it is installed and raised.

Figure 3:
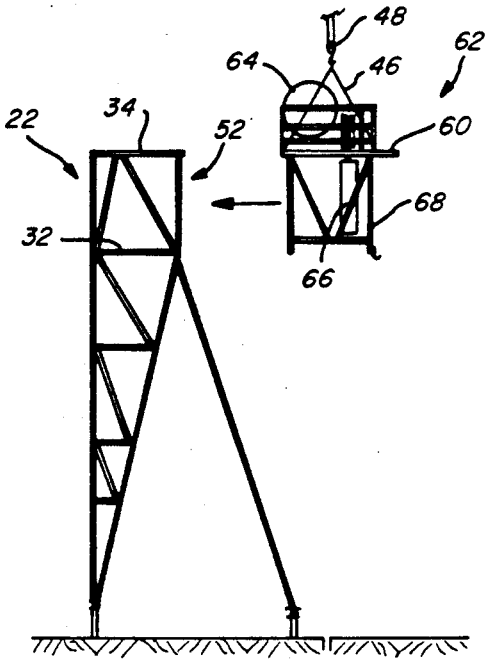

Referring now to FIG. 3, the crane hook 48 is shown connected by the four part sling 46 to a crown platform 60 of the crown section 62. The crown section 62 generally comprises the crown platform 60, a crown block 64, a traveling block 66 and a lower box-like frame 68 mounted on a lower or bottom side of the crown platform 60. The crown section 62 is lifted as a unit by the crane hook 48 and the lower frame 68 is fitted laterally into the U-shaped box 52 of the bottom mast section 22 through its open side.

The crown section 62 is then lowered until it rests on connector latches formed on the U-shaped box 52. The connector latches used to hold the crown section 62 to the bottom mast section 22 may be of any suitable form.

One form particularly adapted for the present invention are those locking mechanisms, such as locking pins or wedges, as disclosed in commonly owned U.S. Pat. No. 4,885,893 which has been incorporated by reference. These locking pins or wedges function to interlock the mast sections together.

Figure 4:
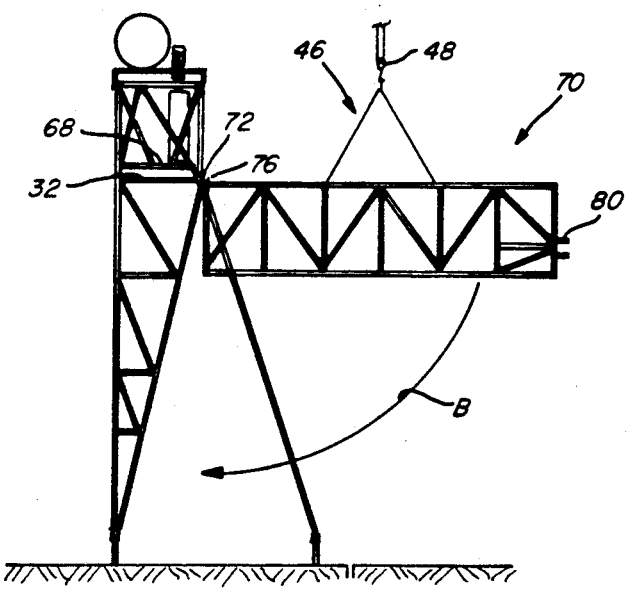

The lower frame 68 of the crown section 62 generally extends below the upper frame members 34 towards the lower frame members 32 between the support legs 26, thereby fitting within the U-shaped box 52, as shown in FIG. 4.

A conventional drill line 86 (FIG. 5) is pulled from a dead line anchor through the crown block 64 and the traveling block 66 and to conventional draw works to complete the stringing up or reeving of the drill line 86. The traveling block 66 is secured during transportation using tie downs or other means of securely fastening the traveling block 66 to the crown section 62. The traveling block 66 is then freed by removing the tie downs.

Referring again to FIG. 4, a top mast section 70 includes a pivot pin 72 mounted on an upper end of the top section 70. The pivot pin 72 is adapted to engage connector hooks 76 mounted near the bottom of the lower frame 68 of the crown section 62. The pivot pin 72 and connector hooks 76 are, for example, similar to the pivot pins and connector hooks disclosed in the above-mentioned commonly owned U.S. patent.

The top mast section 70 is then connected at suitable points to the four part sling 46 beneath the crane hook 48. The top mast section 70 is then lifted by the crane, maintaining the top mast section 70 substantially in its horizontal storage position, and moved to a position as shown (FIG. 4) where the pivot pin 72 engages and fits within the connector hooks 76.

Figure 5:
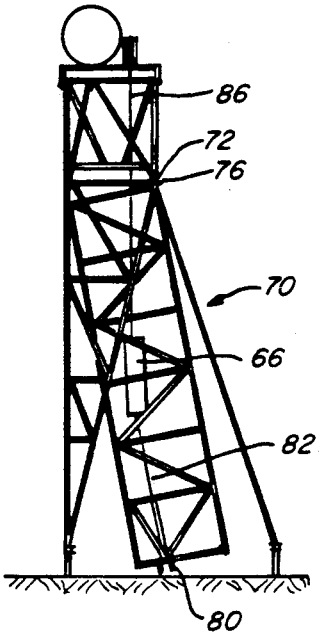

The lifting force exerted by the crane hook 48 is gradually reduced, permitting the top mast section 70 to pivot slowly downwardly as indicated by an arrow B to a lower position within the receiving slot of the bottom mast section 22, as shown in FIG. 5. The engagement of the connector hooks 76 and pivot pin 72 permits controlled and guided pivotal movement of the top mast section 70 relative to the bottom mast section 22, so that the top mast section 70 is lowered and rotated to nest inside the bottom mast section 22.

A pair of guide pulleys 80 are provided on the lower end of the top mast section 70. A connector mechanism is formed at the upper end of the top mast section 70 to align and connect with a similar connector mechanism formed at the lower end of the lower frame 68 of the crown section 62 to lock the crown section 62 together with the top mast section 70. The connector mechanisms may be connector lugs or other similar connecting means known in the art, such as more fully described in the commonly owned U.S. patent previously mentioned.

In the lower position shown in FIG. 5, the connector mechanisms of the top mast section 70 and the crown section 62 can not be brought initially into contact with each other, due to the pivotal connection between the pivot pin 72 and the connector hooks 76. The traveling block 66 is lowered generally within the top mast section 70 and scoping lines 82 (FIG. 7) are fixedly attached at the upper end and side portions of the bottom mast section 22 at scoping line dead end points 84 (FIG. 7) and are then passed over the guide pulleys 80 and attached to the traveling block 66.

Figure 6:
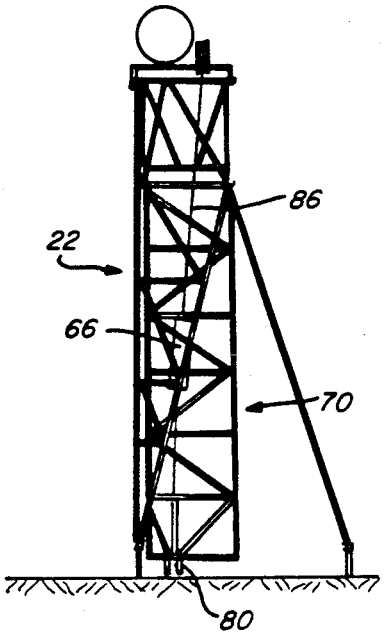

As shown in FIG. 6, the draw works then reels up the drill line 86 to raise the traveling block 66, pivoting the upper end of the top mast section 70 upwardly so that connector mechanisms are aligned and can be locked together. In this manner, the crown section 62 is latched to the top mast section 70. Horizontally slidable latch pins or other suitable means are used to insure that the top mast section 70 remains in a telescoping position within the bottom mast section 22.

Referring again to FIG. 7, the latches or locking mechanisms between the crown section 62 and the bottom mast section 22 are then released, so that the traveling block 66 may be raised to lift the crown section 62 and top mast section 70 upwardly. As the traveling block 66 moves upwardly, the scoping lines 82 pull the top mast section 70 upwardly within the bottom section 22. The horizontally slidable latch pins insure that this movement is a telescoping one.

Upward lifting of the crown section 62 and the top mast section 70 continues until a locking structure at the lower end of the top mast section 70 is aligned with a similar locking structure at the upper end of the bottom mast section 22. The locking structures may be any suitable locking mechanism, such as locking pins, wedges, or latches. The locking structures of the top mast section 70 and the bottom mast section 22 are then locked together so that the top mast section 70 remains intact in the position shown after the scoping lines 82 are released.

Figure 8:
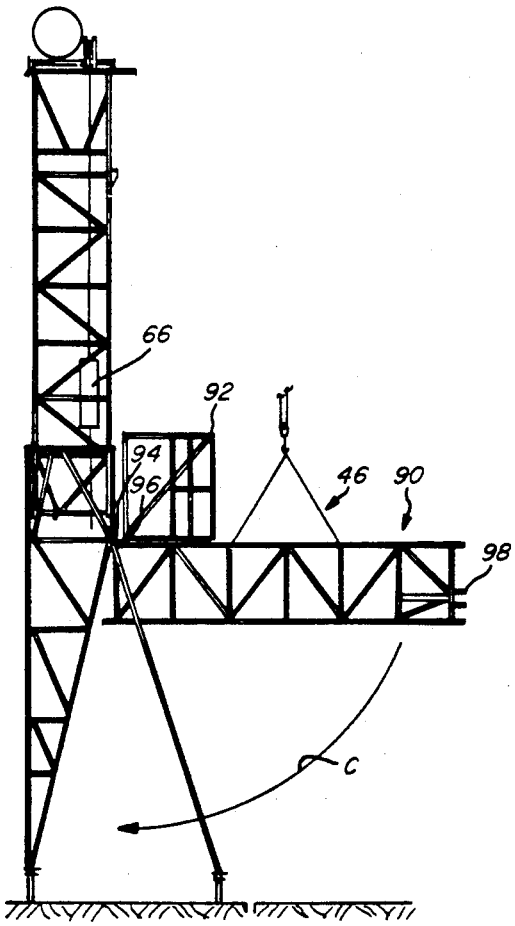
FIGS. 8 and 9 are elevation views of the well mast structure of the present invention during further stages of its being raised.

Referring now to FIG. 8, a middle mast section 90 which is generally of the same size and shape as the top mast section 70 is next included. The middle mast section 90 differs in that it is provided with a racking board 92 mounted near an upper end. The middle mast section 90 is then attached by an installation procedure very similar to that described above for the top mast section 70.

The middle mast section 90 includes a pivot pin 94 mounted near its upper end which is adapted to engage connector hooks 96 mounted at the lower end of the top mast section 70. The pivot pin 94 and connector hooks 96 are preferably the same as the pivot pin 72 and the connector hooks 76. The middle mast section 90 is then lifted using the four part sling 46 in the same manner as the lifting of the top mast section 70 until the pivot pin 94 engages the connector hooks 96. The middle mast section 90 is pivotally lowered as indicated by an arrow C to nest inside the bottom mast section 22.

The traveling block 66 is lowered and the scoping lines 82 are passed over guide pulleys 98 mounted at the lower end of the middle mast section 90 in a similar fashion as described above. The traveling block 66 is lifted until connector mechanisms formed at the upper end of the middle mast section 90 and on the lower end of the top mast section 70 are aligned and locked together in the manner described above.

The locking structure between the top mast section 70 and bottom mast section 22 is released and the middle mast section 90 is raised by the traveling block 66 until it reaches the position shown in FIG. 8. A locking structure at the lower end of the middle mast section 90, which is like in function to the locking structure at the lower end of the top mast section 70, is then aligned with and locked to the locking structure of the bottom mast section 22.

Figure 9:
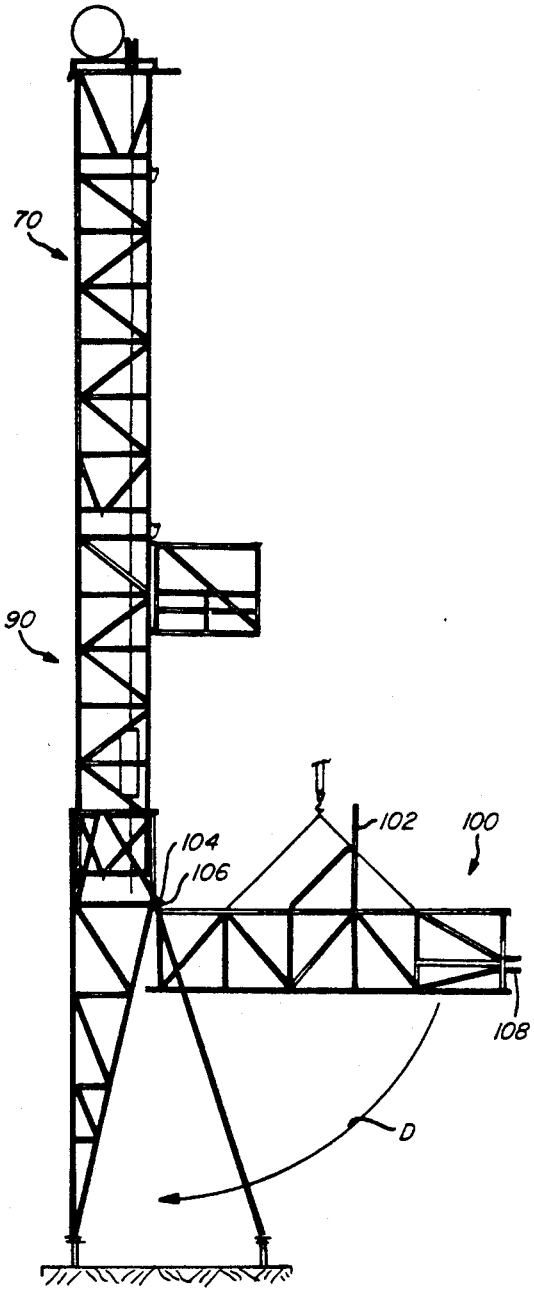

With the present invention, it has been found that an additional mast section, lower mast section 100, can now be added as a part of the well mast structure 20. Referring now to FIG. 9, the lower mast section 100 preferably includes a belly board 102 of the type generally known to those skilled in the art. The installation procedure for the lower mast section 100 is generally the same as described above for the top mast section 70 and middle mast section 90. The lower mast section 100 also includes a pivot pin 104 mounted at an upper end adapted to engage connector hooks 106 mounted at a lower end of the middle mast section 90. The lower mast section 100 is lifted horizontally in the same manner described above until the pivot pin 104 engages the connector hooks 106. The lower mast section 100 is then pivotally lowered to nest within the bottom mast section 22, as indicated by an arrow D.

The lower mast section 100 includes guide pulleys 108 provided at its lower end so that the scoping lines 82 and traveling block 66 can lift the lower mast section 100. The lower mast section 100 is raised by the traveling block 66, in a similar telescoping manner as described above, until a connector mechanism provided at the upper end of the lower mast section 100 is aligned with and connected to a connector mechanism mounted at the lower end of the middle mast section 90. The locking structure between the middle and bottom mast sections is released and the lower mast section 100 is raised until a locking structure mounted at the lower end of the lower mast structure 100 is aligned with and locked to the locking structure of the bottom mast section 22. The raising of the well mast structure 20 is thus completed.

After the well mast structure 20 according to the present invention has been installed in the foregoing manner, it is ready for use in drilling. The new procedure of the present invention allows a taller well mast structure 20 (FIG. 9) where the crown platform 60 is approximately 133 feet above the drill floor 30 and has a net hook capacity which is preferably 400,000 pounds. The present mast structure allows stands of three pipes, the advantages of which are several. First, the well mast structure 20 can handle a larger load, thus a longer drill pipe and a deeper oil well. Second, the larger well mast structure 20 provides more room under the drill floor 30 for blowout prevention handling. Third, removal of the drillpipe from the oil well is faster and more efficient since the increased height of the well mast structure 20 allows three joints of 30 foot pipe to be unscrewed from the drillpipe at a time, as opposed to two joints at a time. This allows the drillpipe to be removed in approximately two-thirds the time and at less cost. For example, a drillpipe which is approximately 2,700 feet in length, thereby including 90 joints of 30 foot pipe, may be removed from the well by unscrewing only 30 stands of pipe (requiring 29 connections to be unscrewed) as opposed to 45 stands of pipe (requiring 44 connections to be unscrewed).

Having described the invention above, various modifications of the techniques, procedures, material and equipment will be apparent to those in the art. It is intended that all such variations within the scope and spirit of the appended claims be embraced thereby.

We claim:

1. A method of raising a well mast at a well site, comprising the steps of:

attaching a bottom mast section having an upper end and a lower end to a well platform;

positioning the bottom mast section in a fixed substantially vertical position on the well platform;

grasping a crown section including a crown platform and a lower end;

moving the crown section to a location near the upper end of the bottom mast section;

inserting the crown section through an open side of the upper end of the bottom section and positioning the crown section to rest on top of the upper end of the bottom section; and adding further mast sections to complete the well mast.

2. The method of claim 1, wherein said step of adding further mast sections includes the steps of:

grasping a top mast section having an upper end and a lower end;

moving the top mast section to a location near the lower end of the crown section;

connecting the top mast section at a connector position near the upper end of the top mast section to the lower end of the crown section; and releasing the grasp on the top mast section so that the top mast section may rotate to a position within the bottom mast section.

3. The method of claim 2, further including the steps of:

rotating the upper end of the top mast section about its connector position until the top mast section is fixed in a substantially vertical position; and latching the upper end of the top mast section to the lower end of the crown section.

4. The method of claim 3, further including the steps of:

raising the top mast section and the crown section in a telescoping manner within the bottom mast section until the lower end of the top mast section is raised to a position near the upper end of the bottom mast section; and latching the top mast section to the bottom mast section.

5. The method of claim 4, further including the steps of:

grasping a middle mast section having an upper end and a lower end;

moving the middle mast section to a location near the lower end of the top mast section;

connecting the middle mast section at a connector position near the upper end of the middle mast section to the lower end of the top mast section; and releasing the grasp on the middle mast section so that the middle mast section may rotate to a position within the bottom mast section.

6. The method of claim 5, further including the steps of:

rotating the upper end of the middle mast section about the connector position until the middle mast section is fixed in a substantially vertical position; and latching the upper end of the middle mast section to the lower end of the top mast section.

7. The method of claim 6, further including the steps of:

raising the crown, top mast and middle mast sections in a telescoping manner within the bottom mast section until the lower end of the middle mast section is raised to a position near the upper end of the bottom mast section; and latching the middle mast section to the bottom mast section.

8. The method of claim 7, further including the steps of:

grasping a lower mast section having an upper end and a lower end;

moving the lower mast section to a location near the lower end of the middle section;

connecting the lower mast section at a connector position near the upper end of the lower mast section to the lower end of the middle section; and releasing the grasp on the lower mast section so that the lower mast section may rotate to a position within the bottom mast section.

9. The method of claim 8, further including the steps of:

rotating the upper end of the lower mast section about the connector position until the lower mast section is fixed in a substantially vertical position; and latching the upper end of the lower mast section to the lower end of the middle mast section.

10. The method of claim 9, further including the steps of:

raising the crown, top mast, middle mast and lower mast sections in a telescoping manner within the bottom mast section until the lower end of the lower mast section is raised to a position near the upper end of the bottom mast section; and latching the lower mast section to the bottom mast section.

* * * * *